US008554098B2

(12) United States Patent
Nishiyama

(10) Patent No.: US 8,554,098 B2
(45) Date of Patent: Oct. 8, 2013

(54) FIXING APPARATUS AND IMAGE FORMING APPARATUS HAVING THE SAME

(75) Inventor: Ryuji Nishiyama, Kashiwa (JP)

(73) Assignee: Canon Finetech Inc., Misato-Shi (JP)

( * ) Notice: Subject to any disclaimer, the term of this patent is extended or adjusted under 35 U.S.C. 154(b) by 353 days.

(21) Appl. No.: 12/975,857

(22) Filed: Dec. 22, 2010

(65) Prior Publication Data

US 2011/0158671 A1 Jun. 30, 2011

(30) Foreign Application Priority Data

Dec. 24, 2009 (JP) ..... 2009-293573
Dec. 17, 2010 (JP) ..... 2010-281410

(51) Int. Cl.
*G03G 15/20* (2006.01)

(52) U.S. Cl.
USPC ..... 399/69

(58) Field of Classification Search
USPC ..... 399/69, 322, 70
See application file for complete search history.

(56) References Cited

U.S. PATENT DOCUMENTS 8,218,992 B2 * 7/2012 Park ..... 399/69
2003/0180063 A1 * 9/2003 Kanesawa et al. ..... 399/69
2007/0019063 A1 * 1/2007 Yasuda et al.
2007/0025750 A1 * 2/2007 Ando ..... 399/69
2009/0238598 A1 * 9/2009 Park ..... 399/70
2009/0252519 A1 * 10/2009 Yamagata

FOREIGN PATENT DOCUMENTS

JP 04-51179 2/1992
JP 2003-076209 3/2003
JP 2003-173103 6/2003
JP 2009063843 A * 3/2009

* cited by examiner

*Primary Examiner* — Susan Lee
(74) *Attorney, Agent, or Firm* — Fitzpatrick, Cella, Harper & Scinto

(57) ABSTRACT

A fixing apparatus including: a cooling unit which cools a non-sheet-passing area for a small-sized sheet of a fixation area to suppress a temperature rise of the non-sheet-passing area; a temperature detecting unit which detects temperatures of a central portion of a sheet-passing area and the non-sheet-passing area; and a fixing-temperature controller which performs an early-heating, restart-control operation to decrease the temperature of the non-sheet-passing area by the cooling unit for a fixation operation of a large-sized sheet while the heat source is de-energized after a fixing operation of the small-sized sheet is completed, and thereafter restart the energization of the heat source during the cooling-down operation by the cooling unit when the temperature of the non-sheet-passing area is lowered to a set target value lower than a controlled fixing temperature for fixing a toner image to the sheet.

30 Claims, 8 Drawing Sheets

FIG. 8

| TEMPERATURE DIFFERENCE ΔT BETWEEN SUB-THERMISTOR AND MAIN THERMISTOR | ON/OFF PERIOD OF HEATER | |
|---|---|---|
| (Tα-10°C)-Tm | ON | OFF |
| 40°C≦ | 1200ms | 200ms |
| 20°C≦ <40°C | 800ms | 200ms |
| 10°C≦ <20°C | 600ms | 200ms |
| <10°C | 400ms | 200ms |

TEMPERATURE DIFFERENCE AND ON/OFF PERIOD OF HEATER

FIG. 9

| NUMBER OF SUPPLIED SHEETS OF A4R | THE PRESENT INVENTION | CONVENTIONAL ART |
|---|---|---|
| 20 | 3 | 8 |
| 50 | 3 | 18 |
| 70 | 4 | 24 |
| 100 | 5 | 27 |
| 200 | 5 | 30 |

COMPARISON OF SUBSEQUENT SHEET PRINT START TIME AFTER SHEETS OF SMALL SIZE ARE SUPPLIED

FIXING APPARATUS AND IMAGE FORMING APPARATUS HAVING THE SAME

BACKGROUND OF THE INVENTION

Field of the Invention

The present invention relates to a fixing apparatus including a fixation cooling unit, such as a cooling fan, in order to suppress a temperature rise in a non-sheet-passing area for a small-size recording medium of a fixing member for heat-fixing a toner image, and an image forming apparatus having the same.

Description of the Related Art

In general, a fixing apparatus for fixing a toner image formed on a recording medium thereto is widely employed for various kinds of apparatuses including an image forming apparatus, such as a copying machine, a laser beam printer, or a facsimile machine. The fixing apparatus, in which a fixation area is defined at a nip portion between a heating member functioning as a fixing member and a pressure member abutted against the heating member, applies a heating action of a heat source provided in the heating member and applies a pressurizing action of the pressure member while conveying the recording medium on which the toner image is formed into the fixation area, thereby fixing the toner image onto the recording medium. At this time, in order to achieve satisfactory fixation of the toner image, that is, a satisfactory fixing property, in the above-mentioned fixation area, fixation parameters including a heating temperature (controlled temperature) in the fixation area and a recording-medium conveying speed (process speed) need to be satisfactorily adjusted. Therefore, an energization state of the heat source (heater) provided in the heating member functioning as the above-mentioned fixing member is controlled by a fixing-temperature controller provided in an apparatus main body to thereby perform fixing-temperature control.

Here, in a case where the recording medium of a small size is conveyed into the fixation area, the recording medium does not pass, for example, both end parts in a longitudinal direction, and hence the both end parts become a non-sheet-passing area for the small-size recording medium. In a case where such recording media of the small size are used continuously, temperature transitions in the respective portions on the fixing member are obtained as illustrated in FIG. 10. More specifically, the temperature of a sheet-passing area (central portion) indicated by the solid line of FIG. 10 stays around a set target temperature Tα for the fixing-temperature control with stability by the heat-absorbing action of the recording medium being passed, while a non-sheet-passing portion that is not passed by the recording medium comes to a heat-storage state due to an absence of heat absorbed by the recording medium. As a result, the temperature of the non-sheet-passing area for the small-size (end portion) recording medium indicated by the broken line of FIG. 10 continuously rises until a time t4 at which continuous passing of the recording media is finished, which may cause a phenomenon called a non-sheet-passing-portion temperature rise or an end-portion temperature rise.

The non-sheet-passing portion temperature rise or the end-portion temperature rise thus caused in the case where the recording medium of the small size continues may lead to damage to the heating member functioning as the fixing member and the pressure member, and hence conventionally, for example, the heating member functioning as the fixing member is provided with a fixation cooling unit including a cooling fan, the fixation cooling unit being located in both end parts in the longitudinal direction serving as the non-sheet-passing areas for the small-size recording medium. With this structure, the cooling-down operation is performed when the recording medium of the small size is used, thereby attempting to suppress the above-mentioned non-sheet-passing-portion temperature rise or the end-portion temperature rise. Such a cooling-down operation state of the fixation cooling unit (cooling fan) and the energization state of the heat source provided in the heating member functioning as the fixing member are controlled by the fixing-temperature controller provided in the apparatus main body, and so-called fixing-temperature control is performed. In particular, Japanese Patent Application Laid-Open No. H04-51179 and Japanese Patent Application Laid-Open No. 2003-076209 each disclose a fixation cooling unit (cooling fan) which can adjust the length in a width direction of a fan opening in accordance with the width dimension of the recording medium being used, thereby preventing the non-sheet-passing-portion temperature rise from occurring in the recording medium having a different size.

On the other hand, when a recording medium of a large size is passed immediately after the recording media of the small size are continuously passed, sheet passing is performed in a non-sheet-passing-portion area exhibiting a high temperature, and hence a so-called high-temperature offset phenomenon is likely to occur. Therefore, Japanese Patent Application Laid-Open No. 2003-173103 discloses an apparatus which discontinues an image-forming operation and enters a post-rotating operation at the time t4 at which the passing of the recording media of the small size are completed and maintains the cooling-down operation state of the fixation cooling unit (cooling fan) with the sheet of the large size to be fed being in a standby state and with energization of the heat source within a heat-fixing member being in an interrupted state. By such a standby-control operation during post-rotating, the temperature of the non-sheet-passing area for the small size is caused to decrease rapidly as indicated by the curved line X and to agree with a temperature T0 in the sheet-passing area between the above-mentioned time t4 and a time t5. Then, the energization of the heat source within the fixing member is started at the time t5 at which a substantially uniform-temperature distribution state in which both the temperatures thus agree with each other is achieved, and the temperature of the entire fixing member is raised in a substantially uniform state until a time t6 to reach a set target temperature Thα for the subsequent recording medium of the large size, at which the feeding, conveying, and a image-forming processing of the recording medium of the large size are restarted.

However, in a design becoming common in recent years, the heat capacity of the heating member is reduced to as low a level as possible and electric power to the heat source (fixing heater) is increased in order to shorten the time (wait time) required to raise the temperature of the heating member functioning as the fixing member from room temperature to a predetermined fixing temperature. As a result, it becomes difficult to suppress the temperature rise in the non-sheet-passing area for the small size during continuous sheet-passing, and the time required to decrease to the uniformly distributed temperature T0 as in the above-mentioned post-rotating tends to become longer. Further, the time required to raise the temporarily reduced temperature of the fixing member up to the subsequent set target temperature Thα is also longer by the time required to decrease the temperature.

SUMMARY OF THE INVENTION

Therefore, an object of the present invention is to provide a fixing apparatus having a simple structure that can cause a fixing-temperature controller to efficiently perform fixing-temperature control when fixation is performed with respect to the recording medium of a large size after an end-portion temperature rise occurs in a fixing member for continuously performing fixation with respect to recording media of a small size, and an image forming apparatus having the same.

In order to achieve the above-mentioned object, the present invention provides a fixing apparatus for fixing a toner image to a recording medium, on which the toner image is formed, by a heating action of a heat source, which is provided in a fixing member and energized to heat an entirety of a fixation sheet-passing area, while conveying the recording medium in the fixation sheet-passing area defined by the fixing member. The fixing apparatus includes: a fixation cooling unit configured to cool a non-sheet-passing area for a small-size recording sheet of the fixation sheet-passing area to suppress a temperature rise in the non-sheet-passing area for the small-size recording sheet which occurs in the fixing member, in a case in which recording media of a small size, smaller than a maximum sheet-passing size among recording media that pass through the fixing member are continuously fixed; a temperature detecting unit configured to detect the temperature of a central portion of the fixation sheet-passing area and the temperature of the non-sheet-passing area for the small-size recording medium of the fixation sheet-passing area; and a fixing-temperature controller configured to control a cooling-down operation state of the fixation cooling unit and an energization state of the heat source in order to control the temperature of the central portion and the temperature of the non-sheet-passing area for the small-size recording sheet to get a controlled fixing temperature at which the toner image is fixed to the recording medium, wherein the fixing-temperature controller performs an early heating-restart control operation in which the fixing-temperature controller decreases the temperature of the non-sheet-passing area for the small-size recording sheet by continuing a cooling operation performed by the fixation cooling unit in a case where the recording medium having a larger size than the recording medium of the small size is fixed after the energization of the heat source is interrupted after a fixing operation with respect to the recording medium of the small size, and the fixing-temperature controller starts energization of the heat source in a state in which cooling-down operation performed by the fixation cooling unit is continued in a case in which the temperature of the non-sheet-passing area for the small size is lowered to a set target value lower than the controlled fixing temperature.

According to the aspect of the present invention including the above-mentioned structure, cooling is performed for the non-sheet-passing area for the small size even after the energization of the heat source provided in the fixing member is interrupted, and hence the temperature of the non-sheet-passing area for the small-size recording sheet is gradually raised even when the heat source is energized, while the temperature of the sheet-passing area is rapidly raised. Accordingly, unlike the conventional art, without the need to stand by until the temperature of the non-sheet-passing area for the small size and the temperature of the sheet-passing area agree with each other, the heat source can be energized at a stage prior thereto to thereby bring the temperature of the non-sheet-passing area for the small size and the temperature of the sheet-passing area into agreement with each other at an early stage, with the result that a standby time can be shortened.

Further, the early heating-restart control operation according to the aspect of the present invention is desirably performed by the fixing-temperature controller to change the energization period of the heat source configured to heat the entirety of the fixation sheet-passing area based on a temperature difference between the central portion and the non-sheet-passing area for the small-size recording sheet detected by the temperature detecting unit in a case in which the energization of the heat source is started, and to control the energization of the heat source so that in a case in which the temperature of the non-sheet-passing area for the small-size recording sheet of the fixing member reaches the controlled fixing temperature, the temperature of the central portion reaches the controlled fixing temperature.

According to the aspect of the present invention including the above-mentioned structure, the heating is efficiently performed by the heat source provided in the fixing member without waste.

Moreover, the early heating-restart control operation performed by the fixing-temperature controller according to the aspect of the present invention can be performed during post-rotating in an image-formation operation.

As described above, the fixing apparatus and the image forming apparatus having the same according to the present invention causes the fixing-temperature controller to perform the early heating-restart control operation in the fixing-temperature control in a case of restarting the energization of the heat source provided in the fixing member after the end-portion temperature rise occurs in the non-sheet-passing area for the small-size recording sheet, so that the temperature of the non-sheet-passing area for the small-size recording sheet, is raised more slowly than the temperature of the sheet-passing area by energizing the heat source while cooling the non-sheet-passing area for the small-size recording sheet. Therefore, unlike the conventional art, without the need to stand by until the temperature of the non-sheet-passing area for the small-size recording sheet and the temperature of the sheet-passing area agree with each other, the heat source is energized midway therethrough to thereby allow the temperature of the non-sheet-passing area for the small-size recording sheet and the temperature of the sheet-passing area to agree with each other, which can shorten the standby time. Accordingly, with a simple structure, the fixing-temperature controller can efficiently perform the fixing-temperature control in a case of restarting the energization of the heat source provided in the fixing member without requiring a long standby time, and performance of the fixing apparatus and the image forming apparatus having the same can be greatly enhanced at a low cost.

Further features of the present invention will become apparent from the following description of exemplary embodiments with reference to the attached drawings.

BRIEF DESCRIPTION OF THE DRAWINGS

FIG. 8 is a table showing an example of a control table for determining an on/off period of a fixing heater from a temperature difference between both thermistors.

FIG. 9 is a table showing results of comparing the performance between the apparatus according to this embodiment and the apparatus according to a conventional art.

DESCRIPTION OF THE EMBODIMENT

Hereinafter, an embodiment obtained by applying the present invention to a fixing apparatus and a copying machine functioning as an image forming apparatus having the same will be described in detail with reference to the accompanying drawings.

Figure 1:
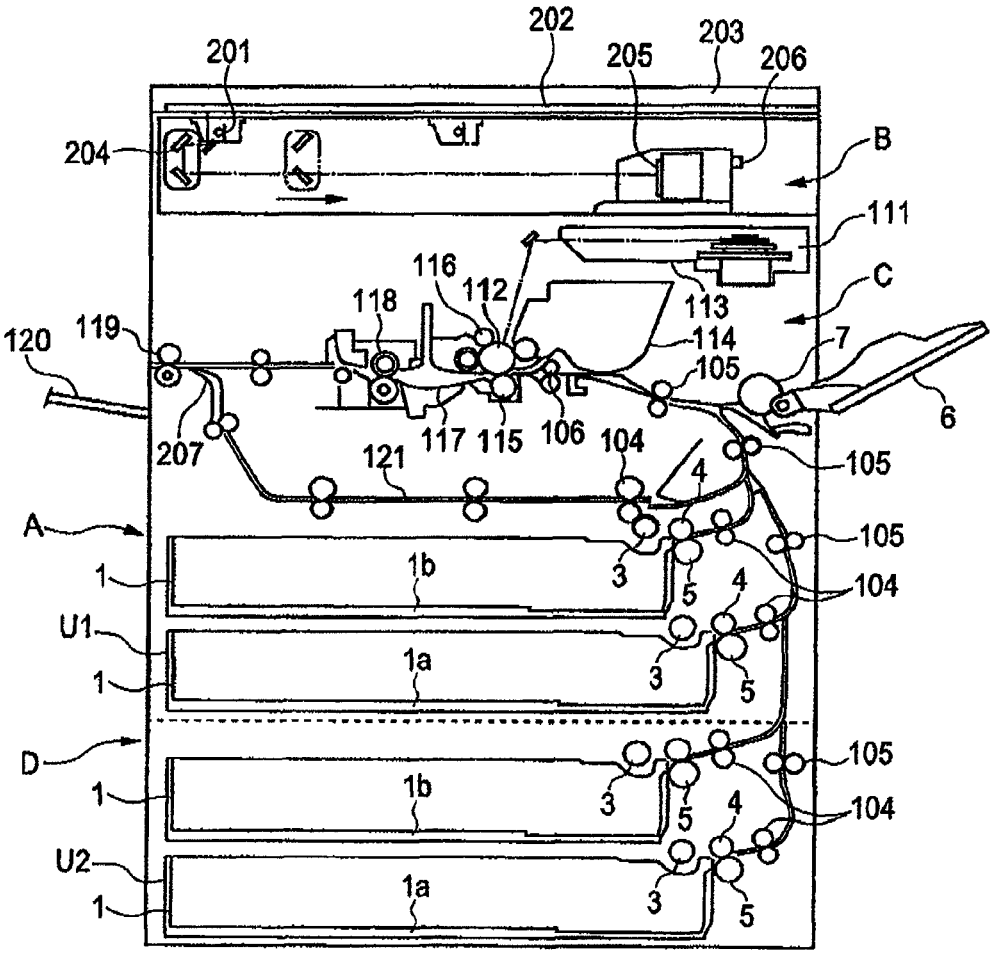
FIG. 1 is an explanatory vertical sectional view illustrating an outline of an overall structure of a copying machine as an example of an image forming apparatus to which the present invention is applied.

First, as illustrated in FIG. 1, the overall structure of the copying machine, to which the present invention is applied, includes a scanner portion B, an image forming portion C, and a sheet deck D, which are provided as portions of an image forming apparatus main body A. The scanner portion B, functioning as an image reading unit configured to read image information of a book original, is located in an upper part of the above-mentioned image forming apparatus main body A, and the image forming portion C, functioning as an image forming unit is provided in a lower part of the image forming apparatus main body A. Further, the sheet deck D is assembled below the image forming portion C.

The above-mentioned scanner portion B includes the respective components such as a scanning system light source 201, a platen glass plate 202, an original pressure plate 203 that can open/close with respect to the image forming apparatus main body A, a mirror 204, a light-receiving element (photoelectric conversion element) 205, and an image processing portion 206. When a reading start key (not shown) is depressed after a book original or a sheet-shaped original such as a book or a recording sheet is placed on the platen glass plate 202 with its original surface facing down and is set at rest with its back surface being pressured by the original pressure plate 203, the scanning system light source 201 reads the image information on the original surface by scanning below the platen glass plate 202 in a direction indicated by the arrow. The image information on the original read by the scanning system light source 201 is processed by the image processing portion 206, converted into an electrical signal, and transmitted to a laser scanner 111 of the image forming portion C. Here, the image forming apparatus main body A functions as a copying machine by inputting a processing signal from the image processing portion 206 to the laser scanner 111 of the image forming portion C, and functions as a printer by receiving an input of a signal output from an external apparatus (computer). Further, the image forming apparatus main body A functions as a facsimile apparatus by receiving a signal from another facsimile apparatus and transmitting a signal from the image processing portion 206 to another facsimile apparatus.

Meanwhile, sheet cassettes 1 are mounted below the above-mentioned image forming portion C. The sheet cassettes 1 constitute one feed unit by combining two sheet cassettes of a lower stage cassette 1*a* and an upper stage cassette 1*b*, and in this embodiment, a total of four cassettes, including two feed units U1 and U2, can be mounted. The one feed unit U1 located at an upper level is detachably mounted to the image forming apparatus main body A, and the other feed unit U2 is detachably mounted to the sheet deck D.

Sheet-shaped recording media (recording sheets) contained inside the lower stage cassette 1*a* and the upper stage cassette 1*b* as described above are sent out by pickup rollers 3 functioning as feeding rotary members, and separated and fed, one by one, by the cooperative action of feed rollers 4 and retard rollers 5. Then, those sheet-shaped recording media are conveyed up to registration rollers 106 by conveying rollers 104 and 105, and fed to the image forming portion C by the registration rollers 106 in synchronization with an image-formation operation described later. Further, a manual feed tray 6 is located on a side surface of the image forming apparatus main body A in addition to the above-mentioned sheet cassettes 1, and a sheet S on the manual feed tray 6 is sent out to the registration rollers 106 by a manual feed roller 7.

Further, the image forming portion C includes an electrophotographic photosensitive drum 112, an image writing optical system 113, a charging roller 116, a developing device 114, and a transfer charger 115. A laser beam corresponding to the image information emitted from the laser scanner 111 is scanned by the image writing optical system 113 on a surface of the electrophotographic photosensitive drum 112 uniformly charged by the charging roller 116 to form an electrostatic latent image, and the electrostatic latent image is developed by the developing device 114, to thereby form a toner image. The toner image formed on the electrophotographic photosensitive drum 112 is transferred onto a first surface of the sheet-shaped recording medium (recording sheet) sent out by the registration rollers 106 in synchronization with rotation of the electrophotographic photosensitive drum 112, at a transfer portion in which the transfer charger 115 is located.

In FIG. 1, a conveying portion 117 conveys the sheet-shaped recording medium (recording sheet) on which the toner image is formed. The sheet-shaped recording medium on which the toner image is formed conveyed to a fixing apparatus 118 by the conveying portion 117. The sheet-shaped recording medium on which the toner image is formed has the toner image fixed to its front surface by being heated and pressurized at the fixing apparatus 118, and is then delivered to a delivery tray 120 by the conveying action of delivery rollers 119, and stacked thereon. As described above, the copying machine functioning as the image forming apparatus illustrated in FIG. 1 includes the fixing apparatus 118 according to the embodiment of the present invention in the image forming portion C.

Further, in order to record images on both surfaces of the sheet-shaped recording medium (recording sheet), when a trailing end of the sheet-shaped recording medium delivered from the above-mentioned fixing apparatus 118 passes a branch point 207 immediately before the delivery rollers 119, the delivery rollers 119 are driven to rotate in a reverse direction after a temporary stop. By this operation, the sheet-shaped recording medium is temporarily placed on a duplex tray 121, and then conveyed by the conveying rollers 104 and 105 to reach the registration rollers 106. An image is formed on a back surface (second surface) of the reversed sheet-shaped recording medium in the same manner as described above, and then delivered to/stacked on the delivery tray 120.

Figure 2:
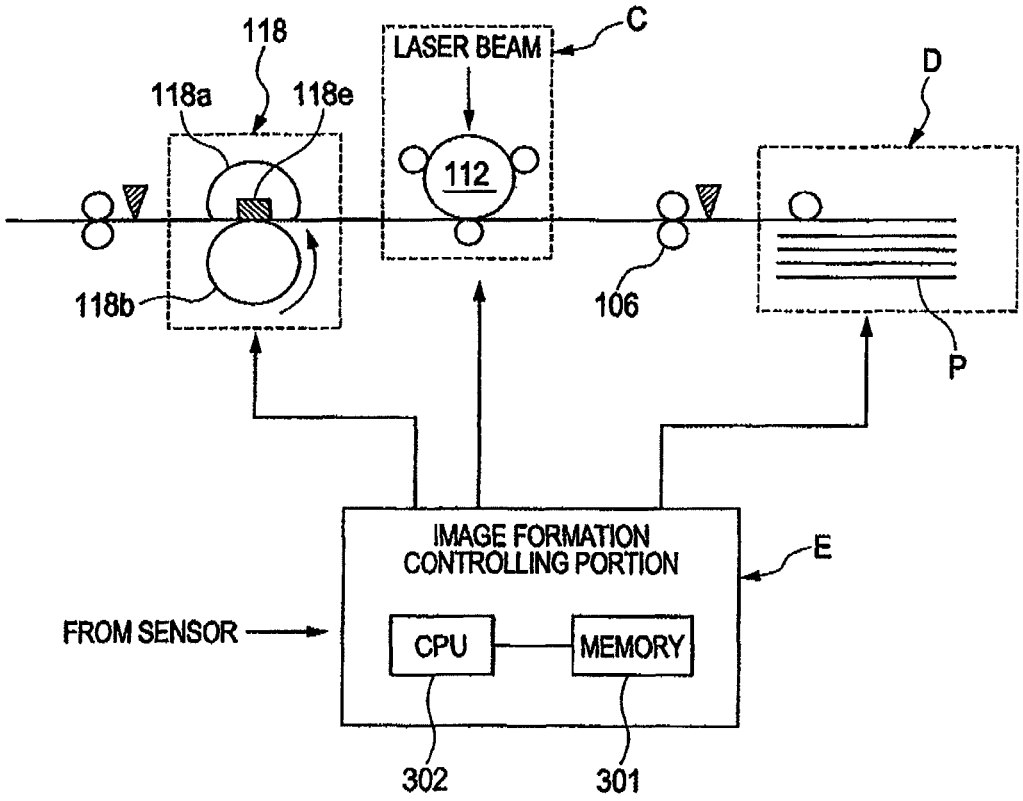
FIG. 2 is a block diagram illustrating a schematic configuration of a control system for executing an image-formation operation of the copying machine illustrated in FIG. 1.

At this time, the respective components performing the above-mentioned image-formation operation are controlled by an image formation controlling portion E as illustrated in FIG. 2. The image formation controlling portion E schematically includes a memory 301 that stores control programs and various kinds of data necessary for the image-formation operation and a CPU 302 for administrating an overall operation of the image forming apparatus by executing the control programs. In addition, such a fixing-temperature controller configured to execute fixing-temperature control in the fixing apparatus 118 as described later forms a part of the image formation controlling portion E.

Figure 3:
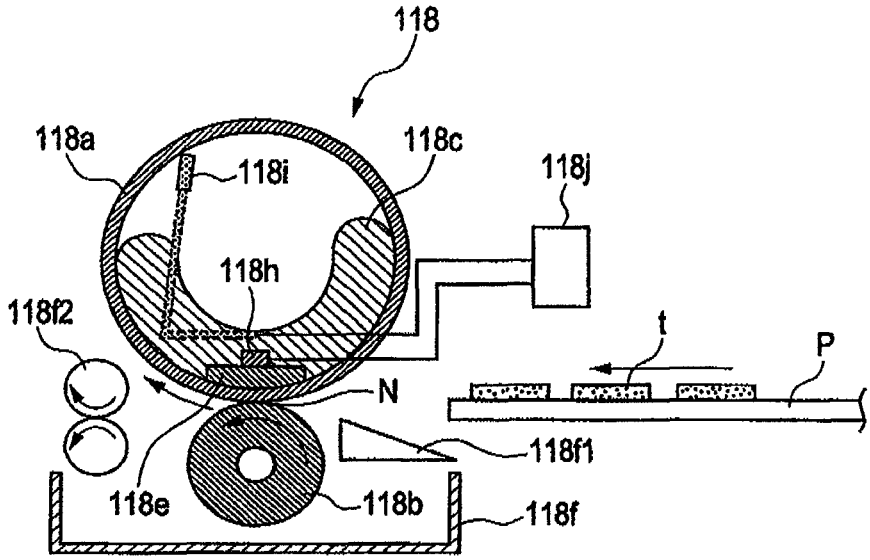
FIG. 3 is an explanatory lateral-sectional view illustrating a schematic structure of a fixing apparatus employed by the copying machine illustrated in FIG. 1.
Figure 4:
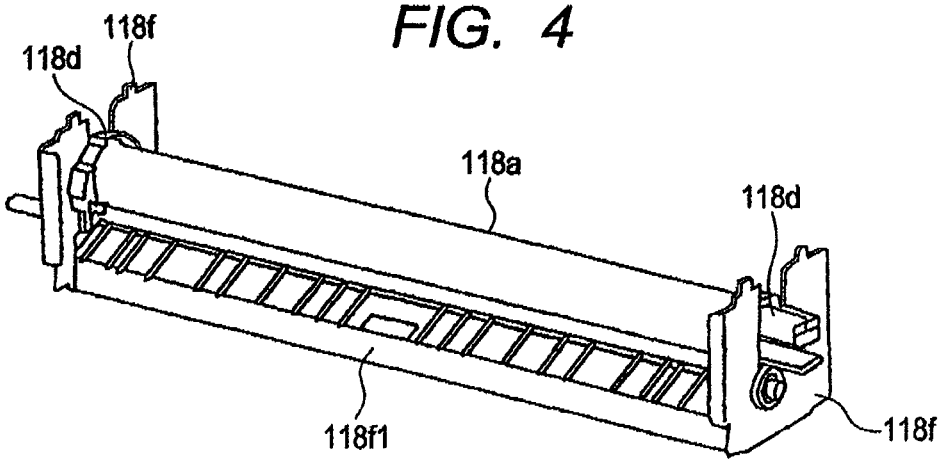
FIG. 4 is an explanatory external perspective view illustrating a schematic structure of the fixing apparatus illustrated in FIG. 3.
Figure 5:
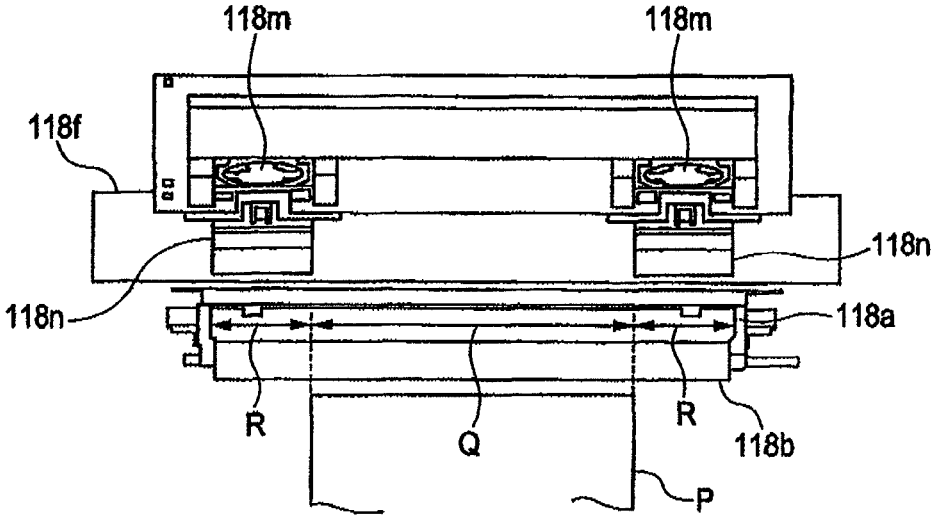
FIG. 5 is an explanatory plan view illustrating a schematic structure of the fixing apparatus illustrated in FIG. 3 and FIG. 4.

On the other hand, the fixing apparatus 118 has a structure that employs a fixing-belt heating system and a rotary-drive-member drive system for pressurization (tensionless type) as illustrated in, for example, FIG. 3 to FIG. 5. A fixing belt 118*a* having a substantially cylindrical shape provided as a first fixing member is formed of a cylindrical-shaped (endless-belt-shaped or sleeve-shaped) member obtained by providing an elastic layer to a belt-shaped member. Located so as to face the fixing belt 118*a* is a pressure roller 118*b* functioning as a second fixing member which is brought into pressure contact with the fixing belt 118*a* from below.

The above-mentioned fixing belt 118*a* is loosely fitted externally along a heater holder 118*c* so as to be slidable in a circle thereabout, the heater holder 118*c* serving as a heat-body holding member, which is like a trough having a substantially semi-circular arc shape when viewed lateral-sectionally and exhibits heat resistance and rigidity. The fixing belt 118*a* has both end portions in a longitudinal direction (axial direction) whose positions are regulated by fixation flanges 118*d* (see FIG. 4), and is caused to move in a circle according to rotation drive of the pressure roller 118*b*. Further, a lengthy fixing heater 118*e* is attached as a heat source to a lower surface part of the heater holder 118*c* illustrated in FIG. 3 so as to extend along a longitudinal direction of the heater holder 118*c*. The fixing belt 118*a* is located in contact with the lower surface of the fixing heater 118*e*.

Here, the pressure roller 118*b* has a stainless core, around which a silicone rubber layer having a thickness of approximately 3 mm is formed by injection molding, the silicone rubber layer being coated with a PFA resin tube having a thickness of approximately 40 μm, and has the core held by bearings at its both end portions so as to be rotatable between a rear side plate and a front side plate of a fixation frame 118*f*. A fixing belt unit including the fixing heater 118*e*, the heater holder 118*c*, and the fixing belt 118*a* is located on the pressure roller 118*b* described above so as to extend substantially in parallel with the pressure roller 118*b*. Both end portions of the heater holder 118*c* according to this embodiment are urged toward an axis of the pressure roller 118*b* by a pressurizing mechanism (not shown) at a pressure of 98 N (10 kgf) on each side, that is, a total pressure of 196 N (20 kgf), which brings the lower surface of the fixing heater 118*e* into pressure contact with the elastic layer of the pressure roller 118*b* through the fixing belt 118*a* with a predetermined pressing force, thereby forming a fixation area N defined by a nip portion having a predetermined width necessary for the fixation. At this time, the pressurizing mechanism has a pressure-releasing mechanism that allows a sheet-shaped recording medium (recording sheet) P within the fixation area N to be easily removed by releasing the pressurization during a jam-clearance processing or the like.

Further, an entrance guide 118*f*1 and fixation delivery rollers 118*f*2 assembled into the fixation frame 118*f* are located in front and back, respectively, in a conveying direction of the sheet-shaped recording medium (recording sheet) P, of the fixation area N defined by a pressure-contact nip portion between the above-mentioned fixing belt 118*a* and the pressure roller 118*b*. The entrance guide 118*f*1 has a function of guiding the sheet-shaped recording medium (recording sheet) P that has passed the transfer area so as to be sent into the fixation area N with accuracy, and is made from, for example, a polyphenylene sulfide (PPS) resin.

As described above, the pressure roller 118*b* is driven to rotate by a driver (not shown) in a direction indicated by the arrow at a predetermined peripheral velocity, a rotational force acts on the fixing belt 118*a* by a rotational frictional force of the pressure roller 118*b*, and the fixing belt 118*a* is driven to rotate in a direction indicated by the arrow around an outer periphery of the heater holder 118*c* while an inner peripheral surface of the fixing belt 118*a* slides while being kept in close contact with the lower surface of the fixing heater 118*e*. At this time, the inner peripheral surface of the fixing belt 118*a* is coated with grease to ensure slidability.

The fixing belt 118*a* is rotated by the rotation drive of the pressure roller 118*b*, while the fixing heater 118*e* thereof is configured to perform the fixing-temperature control according to the control command issued from the above-mentioned fixing-temperature controller. That is, a temperature of the fixing heater 118*e* is raised by energization of the fixing heater 118*e* functioning as the heat source. When the sheet-shaped recording medium (recording sheet) P bearing an unfixed toner image "t" is guided along the entrance guide 118*f*1 and introduced into the pressure-contact nip portion between the fixing belt 118*a* and the pressure roller 118*b*, which define the fixation area N, in a temperature controlled state in which the fixing heater 118*e* has been raised up to a predetermined temperature, a toner-image-bearing surface of the sheet-shaped recording medium P is nipped and conveyed through the fixation area N along with the fixing belt 118*a* while being kept in close contact with the outer peripheral surface of the fixing belt 118*a*. During the nip and conveying process, heat generated from the fixing heater 118*e* is applied to the sheet-shaped recording medium P through the fixing belt 118*a*, and the unfixed toner image "t" on the sheet-shaped recording medium P is heated and pressurized to be subjected to fuse-fixing. The sheet-shaped recording medium P that has passed the fixation area N is self-stripped from the fixing belt 118*a* and delivered toward the outside through the fixation delivery rollers 118*f*2.

The fixing apparatus 118 described above is provided with a two-system, temperature-detecting unit, that is, a main-temperature detecting unit and a sub-temperature detecting unit. That is, a main thermistor 118*h* is located in contact with a top surface, in other words, a back surface of the fixing heater 118*e* functioning as the heat source, and is configured to detect the temperature of the back surface of the fixing heater 118*e*. The main thermistor 118*h* is located on a central portion in a longitudinal direction of the top surface of the fixing heater 118*e*. Further, a sub-thermistor 118*i* is located in a position above the heater holder 118*c* so as to be in elastic contact with the inner peripheral surface of the fixing belt 118*a*, and is configured to detect the temperature of the inner peripheral surface of the fixing belt 118*a*. The sub-thermistor 118*i* is located on the end portion (a position corresponding to the non-sheet-passing area R for the small-size recording medium) in the longitudinal direction of the fixing belt 118*a*. Also, the sub-thermistor 118*i* is not limited to the above mentioned position. In the same way as the main thermistor 118*h* , which is configured to detect the temperature of the back surface of the fixing heater 118*e*, the sub-thermistor 118*i* may be located on the end portion (the position corresponding to the non-sheet-passing area R for the small size recording medium) in the longitudinal direction of the top surface of the fixing heater 118*e*.

The main thermistor 118*h* and the sub-thermistor 118*i* have their respective outputs connected to a control circuit portion (CPU) 118*j* of the fixing-temperature controller configured to execute the fixing-temperature control via an A/D converter (not shown). The control circuit portion 118*j* of the fixing-temperature controller has a function of controlling a heater-drive-circuit portion (power supply portion) (not shown) to energize the fixing heater 118*e* by obtaining a detection temperature based on the outputs from the main thermistor 118*h* and the sub-thermistor 118*i* and determining the temperature control contents for the fixing heater 118*e* from the detection temperature.

Meanwhile, the above-mentioned fixation area N is formed so as to have a lengthy shape in a width direction (axial direction) being the longitudinal direction of the fixing belt 118*a*. Particularly as illustrated in FIG. 5, in the width direction (horizontal direction in FIG. 5) being the longitudinal direction of the fixing belt 118*a*, the fixation area N is classified into a sheet-passing area Q always passed by the sheet-shaped recording medium (recording sheet) P of a small size and non-sheet-passing areas R on both sides thereof which are not passed by the sheet of the small size. When the sheet-shaped recording medium P of the small size, whose width is narrower than a maximum size, passes the fixation area N, the sheet-shaped recording medium P passes only the sheet-passing area Q and does not pass the non-sheet-passing areas R.

Here, a pair of cooling fans 118*m* are located above the fixing belt 118*a* functioning as the above-mentioned fixing member in positions corresponding to the non-sheet-passing areas R. The cooling fans 118*m* constitute a fixation cooling unit configured to cool non-sheet-passing areas, which suppresses the temperature rise in the non-sheet-passing areas R of the fixing belt 118*a*, that is, the fixing member. Employed as the cooling fan 118*m* is an axial fan manufactured at a lower cost than a sirrocco fan or a cross-flow fan with fan air cooling ducts 118*n* extending from the respective cooling fans 118*m* toward the non-sheet-passing areas of the fixing belt 118*a*.

The cooling fans 118*m* functioning as a non-sheet-passing area cooling unit provided for the non-sheet-passing area R as described above perform a cooling-control operation as follows according to an operation command issued from the fixing-temperature controller. First, the sheet-shaped recording medium (recording sheet) P of the small size whose width is narrower than the maximum size is used for image formation. In a case where fixation is continuously performed with respect to the sheet-shaped recording media P of the small size, as described above, the sheet-shaped recording medium P does not pass the non-sheet-passing areas R, and hence a heat-absorbing action is absent in the non-sheet-passing areas R of the fixing belt 118*a*, thereby increasing the temperature. The temperature of the non-sheet-passing area R of the fixing belt 118*a* is detected by the sub-thermistor 118*i* functioning as the sub-temperature detecting unit.

When the temperature detected by the above-mentioned sub-thermistor 118*i* reaches a predetermined temperature, a cooling operation of the cooling fans 118*m* is started to suppress the temperature rise in the non-sheet-passing areas R of the fixing belt 118*a*. Further, when the non-sheet-passing areas R of the fixing belt 118*a* are cooled by the cooling air sent from the cooling fans 118*m* and the temperature detected by the sub-thermistor 118*i* is lowered to a predetermined temperature, the operation of the cooling fans 118*m* is stopped. The cooling-down operation performed by the cooling fans 118*m* functioning as the fixation cooling unit as described above is executed as a common cooling-control operation during a printing operation and also during so-called post-rotating performed after the printing operation of one job is finished.

As described above, in this embodiment, a cooling-down operation state of the cooling fans 118*m* functioning as the fixation cooling unit and an energization state of the fixing heater 118*e* functioning as the heat source for the fixing belt 118*a* provided as the fixing member are appropriately controlled by the fixing-temperature controller to perform the fixing-temperature control, and the fixing-temperature control performed by the fixing-temperature controller further includes an early-heating, restart-control operation as follows. That is, the early-heating, restart-control operation according to this embodiment relates to the fixing-temperature control performed by the fixing-temperature controller during the post-rotating operation after the energization of the fixing heater 118*e* functioning as the heat source is interrupted, and includes a control operation in which the fixing-temperature controller decreases the temperature of the non-sheet-passing areas R of the fixing belt 118*a* functioning as the fixing member by continuing the cooling-down operation performed by the cooling fans 118*m* functioning as the fixation cooling unit after the energization of the fixing heater 118*e* functioning as the heat source is interrupted, and the fixing-temperature controller starts the energization of the fixing heater 118*e* functioning as the heat source when the temperature of the fixing belt 118*a* is lowered to a set target value.

In the early-heating, restart-control operation, the set target value for starting the energization of the above-mentioned fixing heater 118*e* functioning as the heat source is set. The set target value can be set as the temperature of the sheet-passing area Q or the non-sheet-passing area R of the fixing belt 118*a* functioning as the fixing member, or as a difference between the temperature of the sheet-passing area Q and the temperature of the non-sheet-passing area R of the fixing belt 118*a*. In this embodiment, the temperature of the non-sheet-passing area R is set as the set target value, and the early-heating, restart-control operation performed in that case is described with reference to FIG. 6 and FIG. 7.

First, as described above, in a case where continuous printing is performed on small-size paper, the temperature of the fixing belt 118*a* rises particularly in the non-sheet-passing areas R in the vicinities of the end portions in the longitudinal direction. When the temperature detected by the sub-thermistor 118*i* configured to detect the temperature of the non-sheet-passing areas R exceeds a predetermined upper-limit temperature Ta, a cooling-down operation performed by the cooling fans 118*m* functioning as the fixation cooling unit is started (Steps ST1 and ST2 of FIG. 7). The cooling-down operation performed by the cooling fans 118*m* is continued until the detection temperature of the sub-thermistor 118*i* becomes lower than a predetermined lower-limit temperature Tb (Step ST3 of FIG. 7), but even when the detection temperature of the sub-thermistor 118*i* becomes lower than the predetermined lower-limit temperature Tb, the cooling operation performed by the cooling fans 118*m* is continued (Step ST2 of FIG. 7) if the printing operation is not completed (NO in Step ST4 of FIG. 7 described later).

On the other hand, irrespective of the cooling-down operation performed by the cooling fans 118*m* as described above, if the continuous printing is performed on the small-size paper, the temperature of the fixing belt 118*a* may gradually rise until a time t1 at which the last sheet of the continuous printing passes the fixing apparatus 118 as illustrated in FIG.

6. In that case, the detection temperature of the sub-thermistor 118*i* at the end portion in the longitudinal direction exceeds a controlled temperature Tα, and a large temperature difference occurs between the sheet-passing area Q at the central portion in the longitudinal direction of the fixing belt 118*a* and the non-sheet-passing area R at the time t1 at which the last sheet of the continuous printing passes the fixing apparatus 118. The temperature difference becomes larger as the number of continuous prints becomes larger. For example, when 250 sheets of cut paper of A4R size are continuously printed, the temperature detected by the main thermistor 118*h* is maintained at 180° C., being the controlled temperature Tα, while the detection temperature of the sub-thermistor 1181 becomes 240° C., and the temperature difference between the main thermistor 118*h* and the sub-thermistor 118*i* becomes 60° C. A transition is made from such a state in which one job of the continuous printing as described above has been finished into the control operation for the so-called post-rotating operation for reducing the temperature difference between the central portion and the end portion of the fixing belt 118*a* (Step ST5 of FIG. 7).

If the transition has been made into the control operation for post-rotating, and the cooling-down operation performed by the above-mentioned cooling fans 118*m* is continued. When the detection temperature of the sub-thermistor 118*i* is lowered to the predetermined lower-limit temperature Tb (Step ST6 of FIG. 7), the cooling-down operation performed by the cooling fans 118*m* is stopped (Step ST7 of FIG. 7). On the other hand, even if the transition has been made into the post-rotating operation, in the case where the detection temperature of the sub-thermistor 118*i* is not lowered to the predetermined lower-limit temperature Tb (Step ST8 of FIG. 7), the cooling operation performed by the cooling fans 118*m* is continued, and the early-heating, restart-control operation is performed as follows in the fixing-temperature control by the fixing-temperature controller.

Figure 6:
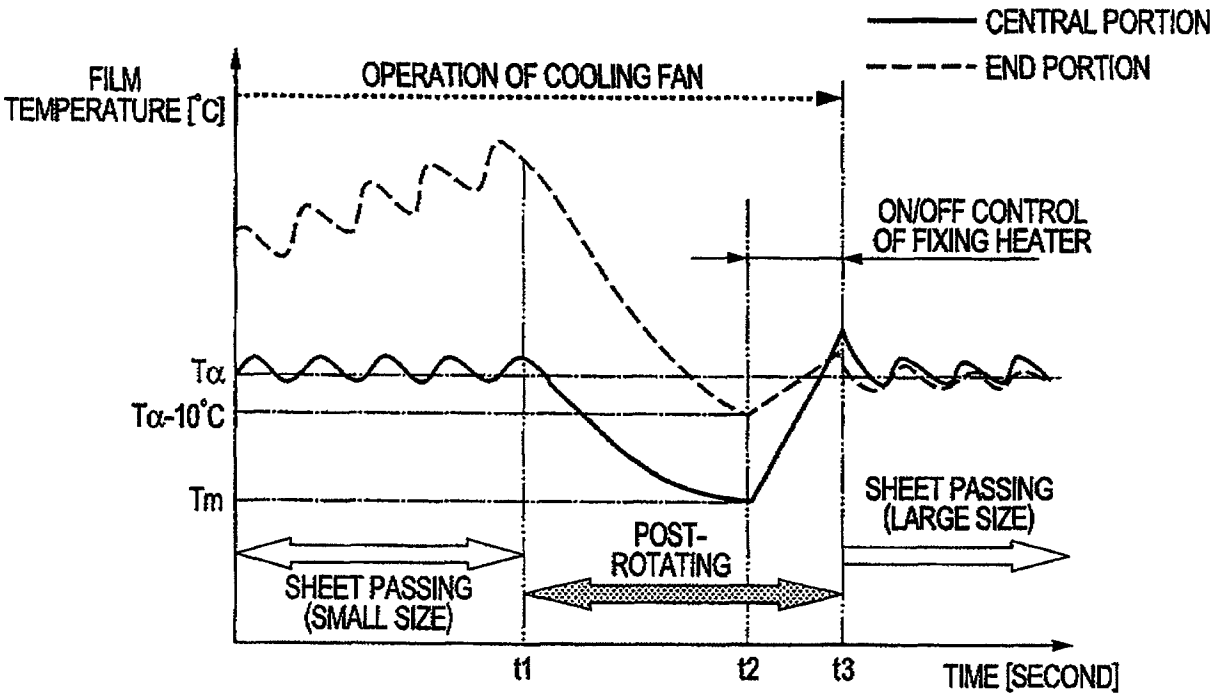
FIG. 6 is a chart illustrating temperature transitions of a fixing belt in a case where fixing-temperature controller according to an embodiment of the present invention executes an early-heating, restart-control operation.
Figure 7:
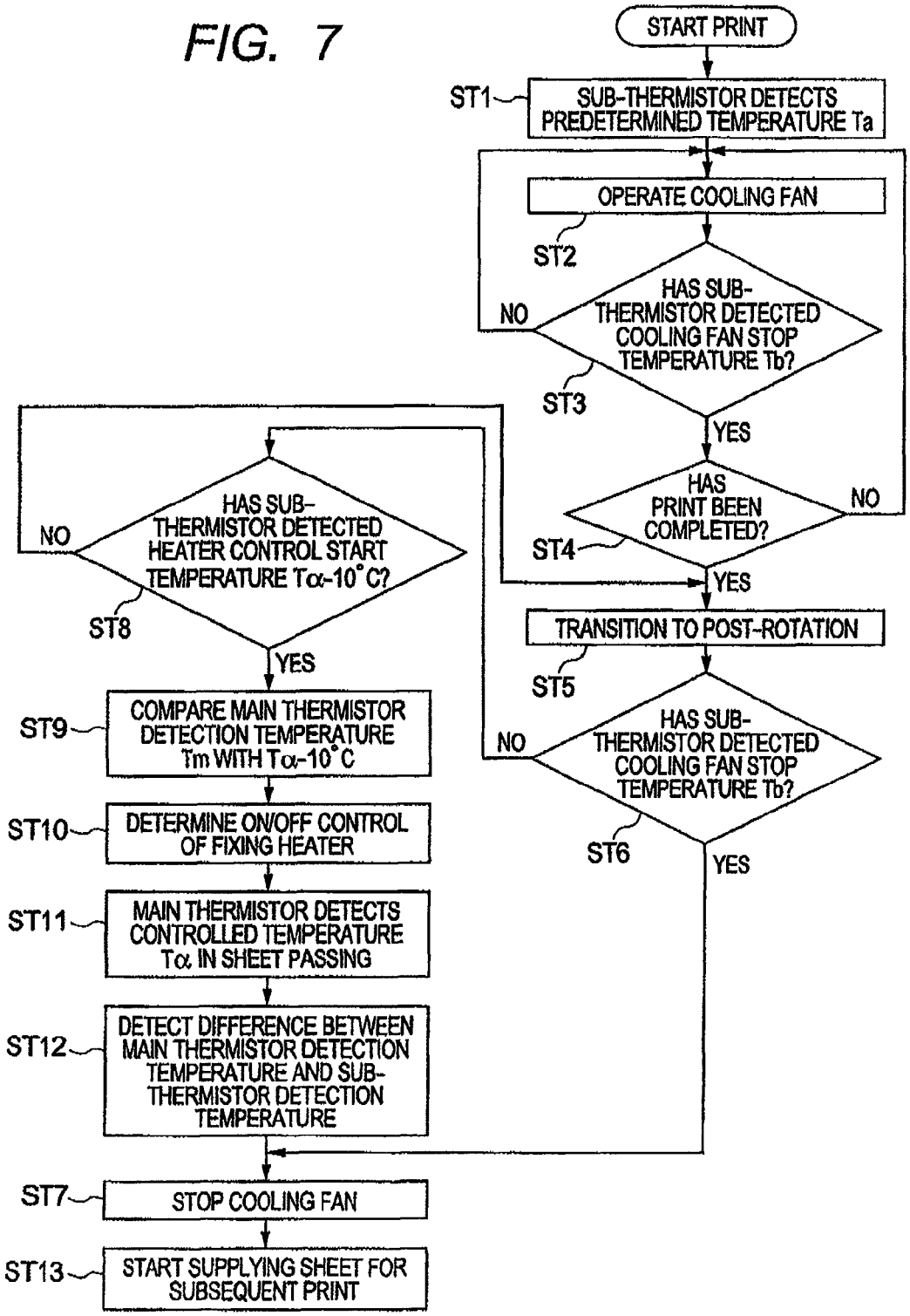
FIG. 7 is an operational flowchart illustrating a procedure for the early-heating, restart-control operation executed by the fixing-temperature controller according to the embodiment of the present invention.
Figure 10:
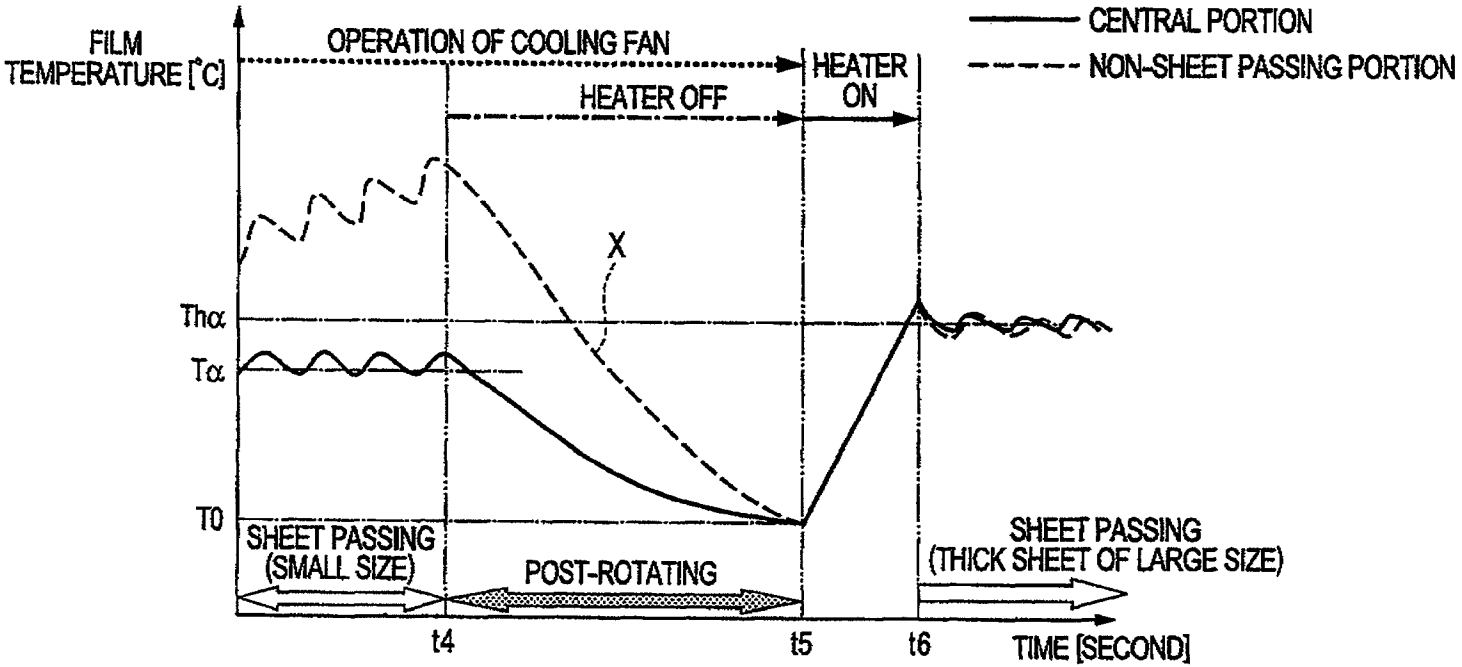
FIG. 10 is a chart illustrating temperature transitions of the fixing belt in a case where a general fixing-temperature controller executes a heating restart control operation.

That is, in the early-heating, restart-control operation according to this embodiment, from the time t1 illustrated in FIG. 6 at which the printing operation of one job is finished, the cooling-down operation performed by the cooling fans 118*m* functioning as the fixation cooling unit is continued under the state in which the energization of the fixing heater 118*e* functioning as the heat source has been interrupted. Then, the temperature of the non-sheet-passing area R of the fixing belt 118*a* functioning as the fixing member is lowered to an appropriate set target value by the cooling-down operation performed by the cooling fans 118*m* (Step ST8 of FIG. 7). The set target value in this embodiment is set to, for example, Tα−10° C. (170° C.) lower by 10° C. than the controlled temperature Tα (180° C.) for the printing operation.

When the temperature of the non-sheet-passing areas R of the fixing belt 118*a* is lowered to Tα−10° C., being the set target value, at that time t2 illustrated in FIG. 6, the energization of the fixing heater 118*e* functioning as the heat source is started. More specifically, when the temperature of the non-sheet-passing areas R of the fixing belt 118*a*, that is, the detection temperature of the sub-thermistor 118*i* at the end portion is lowered to Tα−10° C. (170° C.,) being the set target value, a comparison is performed between Tα−10° C. (170° C.) being the set target value and the temperature Tm detected by the main thermistor 118*h* (140° C.) (Step ST9 of FIG. 7). Then, a comparison result obtained at that time, which is a temperature difference ΔT (ΔT=(Tα−10° C.)−Tm) between the sub-thermistor 118*i* and the main thermistor 118*h* is used in a control table as illustrated in, for example, FIG. 8, and on/off control of the fixing heater 118*e* is determined based on the above-mentioned temperature difference ΔT between both the thermistors and an on/off period of the fixing heater 118*e* (Step ST10 of FIG. 7). For example, if the temperature difference ΔT between both the thermistors is 35° C., an on time and an off time are determined as 800 ms and 200 ms, respectively, for an on/off period of 1 second.

The fixing heater 118*e* functioning as the heat source is energized every thus-determined on/off period, and the temperature of the fixing belt 118*a* functioning as the fixing member is raised from the time t2 until the time t3 illustrated in FIG. 6. In this case, the cooling-down operation of the non-sheet-passing areas R of the fixing belt 118*a* is continuously performed by the cooling fans 118*m*, and hence the temperature of the non-sheet-passing areas R is gradually raised. On the other hand, the temperature of the central portion Q that is not being cooled is rapidly raised.

When the main thermistor 118*h* detects the controlled temperature Tα in the sheet passing by the early-heating, restart-control operation as described above (Step ST11 of FIG. 7), a temperature difference ΔTms between both the thermistors is detected in order to bring the temperature detected by the main thermistor 118*h* and the temperature detected by the sub-thermistor 118*i* substantially into agreement with each other (Step ST12 of FIG. 7). Then, the energization of the fixing heater 118*e* is executed until the time t3 illustrated in FIG. 6 at which the temperature difference ΔTms between both the thermistors becomes lower than 10° C. After that, the cooling-down operation performed by the cooling fans 118*m* is stopped (Step ST7 of FIG. 7), and the transition is made into the subsequent printing operation (Step ST13 of FIG. 7).

The early-heating, restart-control operation thus performed by the fixing-temperature controller according to this embodiment is set to be performed at a timing to start the energization of the fixing heater 118*e* functioning as the heat source so that when the temperature of the non-sheet-passing area R of the fixing member reaches the controlled fixing temperature Tα, the temperature of the central portion Q reaches the controlled fixing temperature Tα. That is, the cooling is performed for the non-sheet-passing area R even after the energization of the fixing heater 118*e* functioning as the heat source provided in the fixing belt 118*a* functioning as the fixing member is started, and hence the temperature of the non-sheet-passing area R is gradually raised even if the fixing heater 118*e* is energized, while the temperature of the central portion Q is rapidly raised. Therefore, unlike the conventional art, without the need to stand by until the temperature of the non-sheet-passing area R and the temperature of the central portion Q agree with each other, the fixing heater 118*e* can be energized at a stage prior thereto, to thereby bring the temperature of the non-sheet-passing area R and the temperature of the central portion Q into agreement with each other at an early stage, with the result that a standby time can be shortened.

FIG. 9 shows results of specifically comparing a time period required to start the image formation with respect to the subsequent sheet-shaped recording medium during the continuous sheet-passing of A4R being the small size between the apparatus according to this embodiment and the apparatus according to the conventional art. In the comparison shown in FIG. 9, the cut paper of A4R size (paper basis weight of 64 g/m$^2$) is used as the sheet-shaped recording medium on conditions that the use environment for a main body of the copying machine has a temperature of 23° C. and a humidity of 50%, a main-body, input-voltage, commercial power is 100V, the controlled temperature Tα for the fixing heater 118*e* is 205° C., and throughput of the cut paper of A4R size is 25 cpm. After the continuous sheet-passing is performed for each number of cut paper of A4R size, a time period required to start the image formation with respect to cut paper of A3 size having a wider width than the A4R size as the subsequent sheet-shaped recording medium is measured.

As a result, after the continuous passing of 70 sheets, 24 seconds is required by the apparatus according to the conventional art, and is reduced to 4 seconds by the apparatus according to the present invention, which indicates that the difference in time period is as long as 20 seconds. As described above, in the case of employing the present invention, a first print time being the initial printing operation of each print job can be shortened, and as a result, the throughput can also be increased.

The embodiment of the invention made by the present inventors has been described above specifically, but the present invention is not limited to the above-mentioned embodiment, and various changes can naturally be made within the scope that does not depart from the gist of the invention.

For example, the description of the above-mentioned embodiment is directed to a case of being applied to the copying machine, but the present invention can be similarly applied to the image forming apparatus such as a printer or other such apparatuses.

As has been described above, the fixing apparatus and the image forming apparatus having the same according to the present invention can be widely applied to diverse image forming apparatuses such as the printer or the copying machine.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Applications No. 2009-293573, filed Dec. 24, 2009, and No. 2010-281410, filed Dec. 17, 2010 which are hereby incorporated by reference herein in their entirety.

What is claimed is:

1. A fixing apparatus for fixing a toner image to a recording medium, on which the toner image is formed, by a heating action of a heat source, which is provided in a fixing member and energized to heat an entirety of a fixation sheet passing area, while conveying the recording medium in the fixation sheet passing area defined by the fixing member, the fixing apparatus comprising:

a fixation cooling unit configured to cool a non-sheet passing area for a small size of the fixation sheet passing area to suppress a temperature rise in the non-sheet passing area for the small size which occurs in the fixing member, in a case in which recording mediums of a small size smaller than a maximum sheet-passing size among recording mediums that pass through the fixing member are continuously fixed;

a temperature detecting unit configured to detect a temperature of a central portion of the fixation sheet passing area and a temperature of the non-sheet passing area for the small size of the fixation sheet passing area; and a fixing temperature controller configured to control a cooling-down operation state of the fixation cooling unit and an energization state of the heat source in order to control the temperature of the central portion and the temperature of the non-sheet passing area for the small size to get a controlled fixing temperature at which the toner image is fixed to the recording medium, wherein the fixing temperature controller performs an early heating restart control operation in which the fixing temperature controller decreases the temperature of the non-sheet passing area for the small size by continuing a cooling operation performed by the fixation cooling unit in a case where the recording medium having a larger size than the recording medium of the small size is fixed after the energization of the heat source is interrupted after a fixing operation with respect to the recording medium of the small size, and the fixing temperature, controller starts energization of the heat source in a state in which cooling-down operation performed by the fixation cooling unit is continued in a case in which the temperature of the non-sheet passing area for the small size is lowered to a set target value lower than the controlled fixing temperature.

2. A fixing apparatus according to claim 1, wherein the early heating restart control operation is performed by the fixing temperature controller to change an energization period of the heat source configured to heat the entirety of the fixation sheet passing area based on a temperature difference between the central portion and the non-sheet passing area for the small size detected by the temperature detecting unit in a case in which the energization of the heat source is started, and to control the energization of the heat source so that in a case in which the temperature of the non-sheet passing area for the small size of the fixing member reaches the controlled fixing temperature, the temperature of the central portion reaches the controlled fixing temperature.

3. A fixing apparatus according to claim 1, wherein the early heating restart control operation is performed by the fixing temperature controller during post-rotating in an image formation operation.

4. An image forming apparatus, comprising an image forming portion comprising a fixing apparatus according to claim 1.

5. An image forming apparatus, comprising an image forming portion comprising a fixing apparatus according to claim 2.

6. An image forming apparatus, comprising an image forming portion comprising a fixing apparatus according to claim 3.

7. A fixing apparatus configured to fix a toner image on a recording medium, the fixing apparatus comprising:

a fixing unit configured to fix the toner image on the recording medium by heat;

a cooling unit configured to cool a heating area of the fixing unit; and a control unit configured to start a predetermined heating of the heating area of the fixing unit while cooling the heating area of the fixing unit by the cooling unit after the heating area of the fixing unit is cooled by the cooling unit.

8. A fixing apparatus according to claim 7, wherein the recording medium is heated when the recording medium is conveyed through the heating area of the fixing unit, and wherein the control unit starts the predetermined heating while the cooling unit cools a predetermined area of the heating area in a direction perpendicular to a recording-material conveying direction after the predetermined area is cooled by the cooling unit in a case where the control unit determines that a temperature of the predetermined area is equal to or higher than a predetermined temperature.

9. A fixing apparatus according to claim 7, wherein the recording medium is heated when the recording medium is conveyed through the heating area of the fixing, and wherein the control unit starts the predetermined heating while the cooling unit cools a predetermined area of the heating area in a direction perpendicular to a recording-material conveying direction in a case where the control unit determines that a temperature of the predetermined area is equal to or lower than a predetermined temperature.

10. A fixing apparatus according to claim 7, wherein the recording medium is heated when the recording medium is conveyed through the heating area of the fixing unit, and wherein the control unit causes the cooling unit to cool a predetermined area of the heating area in a direction perpendicular to a recording material conveying direction in a case where the control unit determines that a temperature of the predetermined area is equal to or higher than a first temperature, and thereafter the control unit starts the predetermined heating while cooling the predetermined area of the heating area by the cooling unit in a case where the control unit determines that a temperature of the predetermined area is equal to or lower than a second temperature.

11. A fixing apparatus according to claim 7, wherein the control unit starts the predetermined heating of the heating area while cooling the heating area by the cooling unit in a case where the control unit determines that a temperature of the heating area cooled by the cooling unit has dropped to a predetermined temperature.

12. A fixing apparatus according to claim 7, wherein the control unit starts the predetermined heating of the heating area while cooling the heating area by the cooling unit after the control unit causes the cooling unit to cool the heating area of the fixing unit, and thereafter the control unit stops the cooling unit from cooling the heating area in a case where the control unit determines that a temperature of the heating area has risen to a predetermined temperature.

13. A fixing apparatus according to claim 7, wherein the recording medium is heated when the recording medium is conveyed through the heating area of the fixing unit, and wherein the control unit prevents the fixing unit from performing the predetermined heating of the heating area of the fixing unit while cooling the heating area of the fixing unit by the cooling unit when the recording medium is conveyed through the heating area of the fixing unit.

14. A fixing apparatus according to claim 7, wherein the recording medium is heated when the recording medium is conveyed through the heating area of the fixing unit, and wherein the control unit starts the predetermined heating of the heating area of the fixing unit while cooling the heating area of the fixing unit by the cooling unit after the recording medium is conveyed through the heating area of the fixing unit.

15. A fixing apparatus according to claim 7, wherein the recording medium is heated when the recording medium is conveyed through the heating area of the fixing unit, and wherein when the recording medium is conveyed through the heating area of the fixing unit, the control unit prevents the cooling unit from cooling the heating area of the fixing unit and prevents the fixing unit from performing the predetermined heating of the heating area while cooling the heating area of the fixing unit by the cooling unit after the cooling.

16. A fixing apparatus according to claim 7, wherein the recording medium is heated when the recording medium is conveyed through the heating area of the fixing unit, and wherein the recording medium is conveyed through the heating area of the fixing unit, and thereafter the cooling unit cools the heating area of the fixing unit, and thereafter the control unit starts the predetermined heating of the heating area of the fixing unit while cooling the heating area of the fixing unit by the cooling unit.

17. A fixing apparatus according to claim 7, wherein the recording medium is heated when the recording medium is conveyed through the heating area of the fixing unit, and wherein the control unit starts the predetermined heating while cooling by the cooling unit after the cooling unit cools a predetermined area of the heating area in a case where a size of the recording medium in a direction perpendicular to a conveying direction becomes larger, the conveying direction being a direction in which the recording medium is conveyed through the heating area.

18. A fixing apparatus configured to fix a toner image on a recording medium, the fixing apparatus comprising:

a fixing unit configured to fix the toner image on the recording medium by heat;

a cooling unit configured to cool a heating area of the fixing unit; and a control unit configured to start a predetermined heating of the heating area of the fixing unit while cooling the heating area of the fixing unit by the cooling unit in a case where the control unit determines that a temperature of the heating area of the fixing unit has dropped to a predetermined temperature.

19. A fixing apparatus according to claim 18, wherein the recording medium is heated when the recording medium is conveyed through the heating area of the fixing unit, and wherein the control unit prevents the fixing unit from performing the predetermined heating of the heating area of the fixing unit while cooling the heating area of the fixing unit by the cooling unit when the recording medium is conveyed through the heating area of the fixing unit.

20. A fixing apparatus according to claim 18, wherein the control unit causes the cooling unit to cool the heating area to lower the temperature of the heating area to the predetermined temperature.

21. A fixing apparatus according to claim 20, wherein the control unit prevents the cooling unit from cooling the heating area to lower the temperature of the heating area to the predetermined temperature when the recording medium is conveyed through the heating area of the fixing unit.

22. A fixing apparatus according to claim 18, wherein the recording medium is heated when the recording medium is conveyed through the heating area of the fixing unit, and wherein the control unit starts the predetermined heating of the heating area of the fixing unit while cooling the heating area of the fixing unit by the cooling unit after the recording medium is conveyed through the heating area of the fixing unit.

23. A fixing apparatus according to claim 22, wherein the control unit causes the cooling unit to cool the heating area to lower the temperature of the heating area to the predetermined temperature.

24. A fixing apparatus according to claim 23, wherein the control unit causes the cooling unit to cool the heating area to lower the temperature of the heating area to the predetermined temperature after the recording medium is conveyed through the heating area of the fixing unit.

25. A fixing apparatus according to claim 18, wherein the recording medium is heated when the recording medium is conveyed through the heating area of the fixing unit, and wherein the control unit starts the predetermined heating of the heating area of the fixing unit while cooling the heating area of the fixing unit by the cooling unit in a case where a size of the recording medium in a direction perpendicular to a conveying direction becomes larger, the conveying direction being a direction in which the recording medium is conveyed through the heating area.

26. A fixing apparatus according to claim 25, wherein the control unit causes the cooling unit to cool the heating area to lower the temperature of the heating area to the predetermined temperature.

27. A fixing apparatus according to claim 26, wherein the control unit causes the cooling unit to cool the heating area to lower the temperature of the heating area to the predetermined temperature in a case where the size of the recording medium in the direction perpendicular to the conveying direction becomes larger, the conveying direction being a direction in which the recording medium is conveyed through the heating area.

28. A fixing apparatus configured to fix a toner image on a recording medium, the fixing apparatus comprising:

a fixing unit configured to fix the toner image on the recording medium by heat, the fixing unit heating the recording medium when the recording medium is conveyed through a heating area of the fixing unit;

a cooling unit configured to cool the heating area of the fixing unit; and a control unit configured to perform a predetermined heating of the heating area of the fixing unit while cooling the heating area of the fixing unit by the cooling unit, the control unit preventing the fixing unit from performing the predetermined heating of the heating area of the fixing unit while cooling the heating area of the fixing unit by the cooling unit when the recording medium is conveyed through the heating area of the fixing unit.

29. A fixing apparatus configured to fix a toner image on a recording medium, the fixing apparatus comprising:

a fixing unit configured to fix the toner image on the recording medium by heat, the fixing unit heating the recording medium when the recording medium is conveyed through a heating area of the fixing unit;

a cooling unit configured to cool the heating area of the fixing unit; and a control unit configured to perform a predetermined heating of the heating area of the fixing unit while cooling the heating area of the fixing unit by the cooling unit, the control unit starting the predetermined heating of the heating area of the fixing unit while cooling the heating area of the fixing unit by the cooling unit after the recording medium is conveyed through the heating area of the fixing unit.

30. A fixing apparatus configured to fix a toner image on a recording medium, the fixing apparatus comprising:

a fixing unit configured to fix the toner image on the recording medium by heat, the fixing unit heating the recording medium when the recording medium is conveyed through a heating area of the fixing unit;

a cooling unit configured to cool the heating area of the fixing unit; and a control unit configured to perform a predetermined heating of the heating area of the fixing unit while cooling the heating area of the fixing unit by the cooling unit, the control unit starting the predetermined heating of the heating area of the fixing unit while cooling the heating area of the fixing unit by the cooling unit in a case where a size of the recording medium in a direction perpendicular to a conveying direction becomes larger, the conveying direction being a direction in which the recording medium is conveyed through the heating area.

* * * * *